US005426879A

United States Patent [19]

Hecker

[11] Patent Number: 5,426,879

[45] Date of Patent: Jun. 27, 1995

[54] WALL HANGABLE WINDOW SIMULATING UNIT

[76] Inventor: Irv Hecker, 603 Tegner Way, Rockville, Md. 20850

[21] Appl. No.: 229,850

[22] Filed: Apr. 19, 1994

Related U.S. Application Data

[63] Continuation of Ser. No. 963,518, Oct. 20, 1992, abandoned, which is a continuation of Ser. No. 787,779, Nov. 6, 1991, abandoned, which is a continuation of Ser. No. 363,740, Jun. 9, 1989, abandoned.

[51] Int. Cl.[6] ..... A47F 11/06

[52] U.S. Cl. ..... 40/427; 40/564; 362/812

[58] Field of Search ..... 40/152.2, 427, 434, 40/540, 545, 564, 575; 362/147, 224, 255, 256, 295, 364, 812

[56] References Cited

U.S. PATENT DOCUMENTS

| | | | |
|---|---|---|---|
| D. 272,791 | 2/1984 | Brobakken | D6/301 |
| D. 277,063 | 1/1985 | Hauser | D6/300 X |
| D. 303,180 | 9/1989 | Cheng | D6/300 X |
| 555,113 | 2/1896 | Oehring et al. | 272/10 |
| 732,158 | 6/1903 | Bicknell | 211/45 |
| 920,593 | 5/1909 | Leslie . | |
| 1,348,957 | 8/1920 | Pope | 40/444 |
| 1,546,089 | 7/1925 | Leachman et al. | 40/564 |
| 1,607,922 | 11/1926 | Schweitzer | 362/125 |
| 1,725,230 | 8/1927 | Ulrich | 40/564 |
| 1,769,243 | 7/1930 | Tout | 40/564 |
| 2,197,965 | 4/1940 | Booth | 160/115 |
| 2,218,828 | 10/1940 | Ne Page | 40/152.2 X |
| 2,323,059 | 6/1943 | Land . | |
| 2,395,043 | 2/1946 | Schepmoes | 362/806 |
| 2,464,945 | 3/1949 | Rouse . | |
| 2,567,561 | 9/1951 | Hoffman . | |
| 2,654,827 | 10/1953 | Pierce | 362/147 |
| 2,702,440 | 2/1955 | Marchand . | |
| 2,727,327 | 12/1955 | Colby | 428/14 X |
| 2,814,895 | 12/1957 | Flam | 40/160 |
| 2,861,173 | 11/1958 | Nordquist | 272/18 |
| 2,902,787 | 9/1959 | Cook | 40/564 X |
| 3,024,701 | 3/1962 | Marks et al. . | |
| 3,054,204 | 9/1962 | Yates | 40/434 |
| 3,124,639 | 3/1964 | Kahn . | |
| 3,184,594 | 5/1965 | Siegel | 248/317 |
| 3,227,061 | 1/1966 | Swayze | 52/27 X |
| 3,271,568 | 9/1966 | Lundberg | 362/812 X |
| 3,294,964 | 12/1966 | Schwartz . | |
| 3,350,982 | 11/1967 | Marks . | |
| 3,438,691 | 4/1969 | Makas . | |
| 3,447,274 | 6/1969 | Davidson | 40/152 |
| 3,829,998 | 8/1974 | Flax . | |
| 4,016,309 | 4/1977 | Itoh | 40/564 X |

(List continued on next page.)

FOREIGN PATENT DOCUMENTS

| | | | |
|---|---|---|---|
| 413323 | 8/1910 | France | 40/152.2 |
| 668822 | 1/1989 | Switzerland | 362/255 |
| 2084461 | 4/1982 | United Kingdom . | |
| 8502245 | 5/1985 | WIPO | 40/367 |

OTHER PUBLICATIONS

The Sun Box TM Company, Inc.—The Sun Box 1.
Scotchlamp Film TM 3M–pp. 1–10.
Home Mechanix, Feb. 1988, p. 20.

*Primary Examiner*—Brian K. Green
*Attorney, Agent, or Firm*—Lowe, Price, LeBlanc & Becker

[57] ABSTRACT

A natural daylight window simulation unit includes a thin supporting structure, a sheet of transparent material with imprinted indicia thereon representing a view, supported in this structure, and a thin, natural-like daylight backlighting system provided in supporting structure for supplying evenly diffused backlighting to the sheet of transparent material, to create in combination with the imprinted transparency a simulation unit supplying natural daylight especially to a windowless interior. The simulated daylight window units can be made in the form of a window or a skylight or a door with window panels.

21 Claims, 5 Drawing Sheets

U.S. PATENT DOCUMENTS 4,034,494 7/1977 Lane .
4,071,748 1/1978 Dey .
4,074,124 2/1978 Maute et al. ..... 362/217
4,123,141 10/1978 Schuler .
4,267,489 5/1981 Morohashi .
4,318,163 3/1982 Bryan ..... 362/217
4,335,421 6/1982 Modia et al. .
4,352,149 9/1982 Stetler ..... 362/811 X
4,414,767 11/1983 Staton .
4,418,378 11/1983 Johnson ..... 362/311
4,432,044 2/1984 Lautzenheiser ..... 362/256 X
4,441,145 4/1984 Antkowiak ..... 362/404 X
4,469,726 9/1984 Niinivuo .
4,504,892 3/1985 Zulfilar ..... 362/295 X
4,542,449 9/1985 Whitehead .
4,564,886 1/1986 Morcheles .
4,649,462 3/1987 Dobrowolski et al. ..... 362/19 X
5,038,259 8/1991 Katoh et al. ..... 362/256

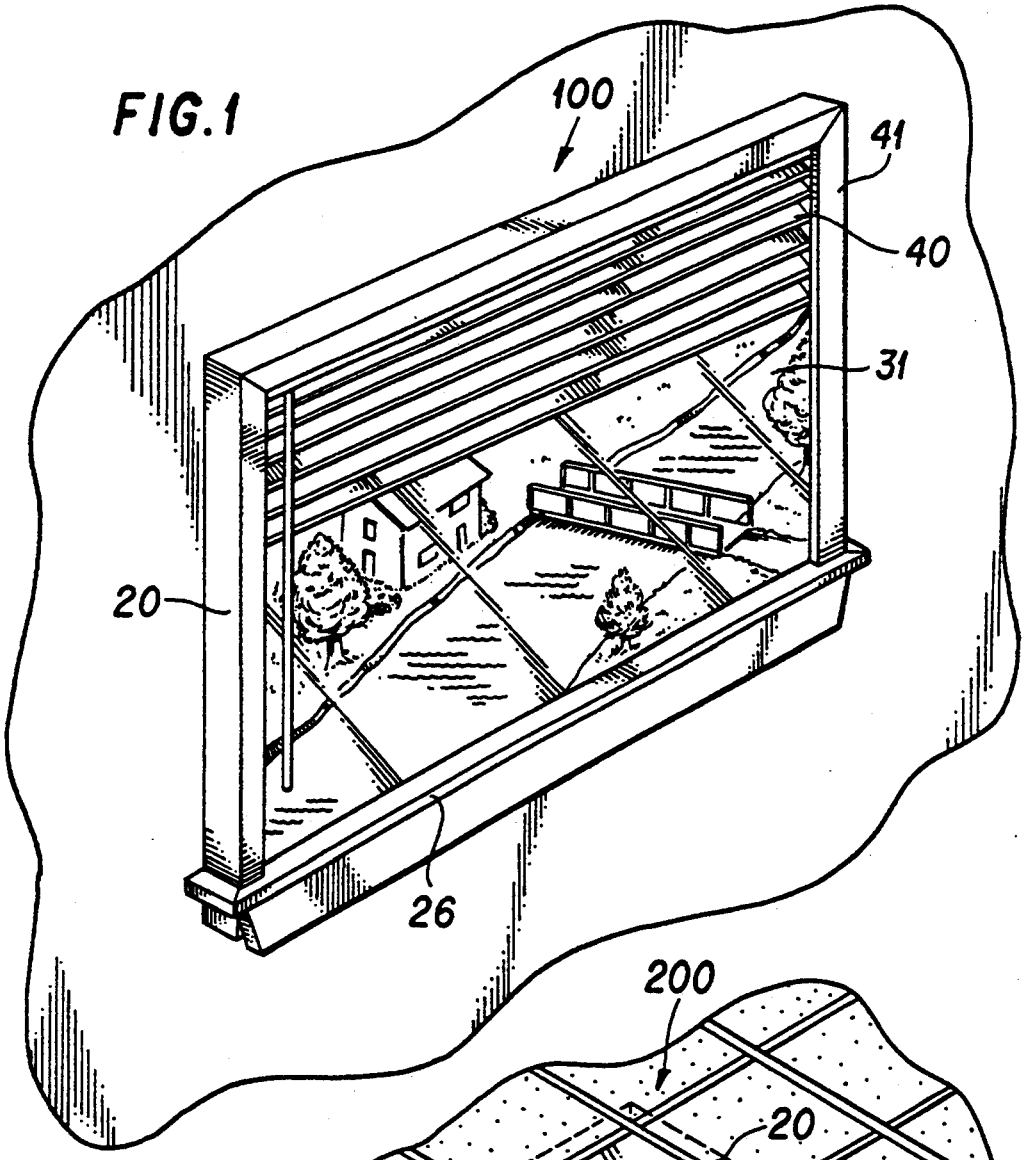
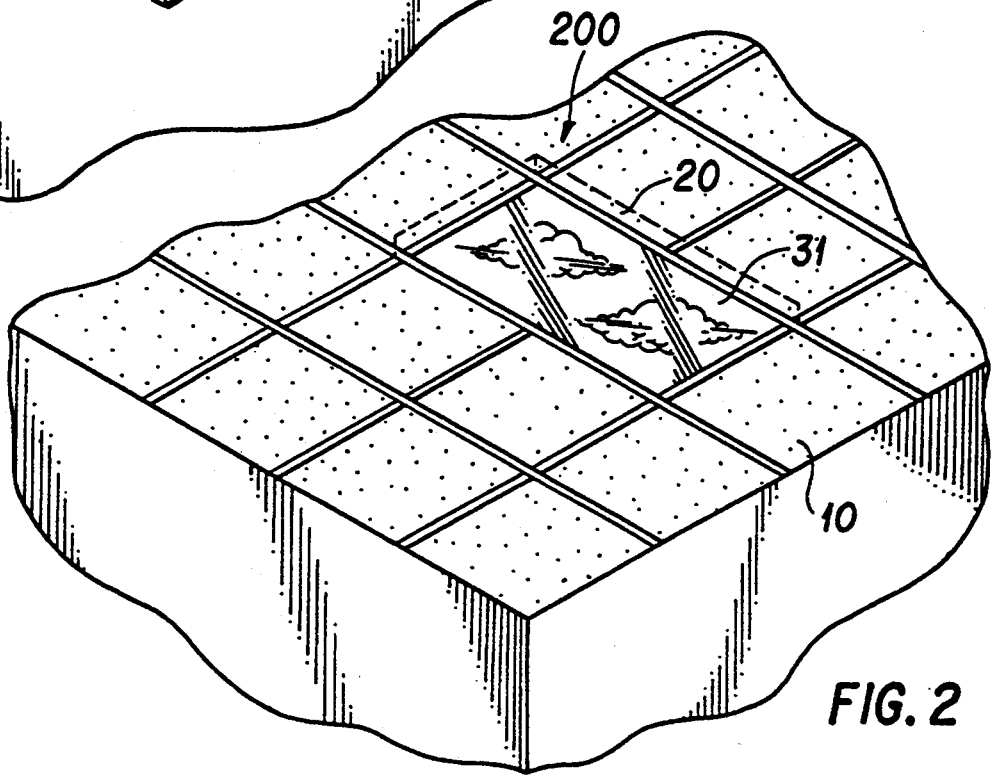
FIG. 2

WALL HANGABLE WINDOW SIMULATING UNIT

This is a continuation of application Ser. No. 07/963,518 filed Oct. 20, 1992, now abandoned, which is a continuation of Ser. No. 07/787,779, filed Nov. 6, 1991, now abandoned, which is a continuation of Ser. No. 07/363,740, filed Jun. 9, 1989 now abandoned.

FIELD OF THE INVENTION

This invention relates to units for simulating natural daylight and specifically to simulated window units for mounting on the wall (windows and doors with windows) and the ceiling (skylights) of a structure.

BACKGROUND ART

It has become quite common in large buildings nowadays to design many interior spaces, including working areas and public rooms, without means for supplying natural daylight. This creates various problems associated with such windowless working environments. The inventor has observed that environments which are windowless and deprived of any significant source of natural daylight, are known to lead to physical and psychological problems which, in turn, decrease the productivity of people working in the windowless offices.

The inventor has conducted extensive studies to determine the influences of light, color and lack of windows on the mood, health and productivity of employees. He has observed that the quality of light, presence of windows, and even the views through a window can greatly effect the mood, work, and mental and physical health of people.

The inventor has observed that most people dislike windowless environments. They feel boxed-in, disconnected, and cheerless. The problem is compounded during fall and winter by dwindling hours of sunlight. Energy and productivity often sag.

Windows and sunlight can affect a person's rhythms and moods profoundly. Light influences how one interacts with other people, one's happiness, productivity and even health. People gravitate towards windows because they instinctively understand that windows and sunlight make them feel better.

It has been known in the art to provide various illuminated, decorative panels, room display units and units with the appearance of windows mainly to enhance the aesthetic appearance of interiors or for advertising purposes. Examples of such panels are, for example, suggested in British Patent No. 2,084,461, or U.S. Pat. No. 4,034,494. The structure of both display units have significant thickness of the panel boxes, do not emanate light evenly, do not emanate an "outdoors" spectrum of light, and thus do not create an impression and feeling of natural windows.

Light-boxes which are used for backlighting of advertising transparencies and decorative panels have to be 5"–8" deep in order to provide evenly diffused light. If they were used as part of simulated windows, such prior art light boxes would cause the appearance of the unit to be bulky and disturbingly unnatural on the wall or on the ceiling, thus negating the attempt to make the unit look like and have the psychological impact of a realistic-looking window.

Various attempts have also been made in the lighting industry to improve the working environment of interiors supplied with artificial light by directing the improvements to the quality of the artificial light. It is known, for example, to provide lighting fixtures with polarizing panels to reduce glare which, in turn, tends to reduce fatigue and headaches among people. In addition, there are available lamps (bulbs) which emit light similar to the daylight spectrum. Some lamps have characteristic colors which have been shown to be helpful in terms of color accuracy and color preferences to the human eye.

In recent years "light therapy" boxes have also been available. Light therapy is now frequently prescribed by physicians for a number of problems, most commonly SAD (Seasonal Affective Disorder), a depression thought to be caused by insufficient exposure to daylight. These light boxes emit intense light with a daylight spectrum, but are unattractive and generally uncomfortable to use. They are typically prescribed for periods of 30 minutes to 3 hours a day. Their shape, light unevenness and intensity and significant cost make them unsuitable for use as part of a daylight window simulation unit.

SUMMARY OF THE INVENTION

The inventor has discovered that simulated windows with simulated natural daylight effects, in such windowless environments, are very beneficial.

The present invention focuses on the creation of lighting units which through their structural appearance and quality of delivered light create an illusion of supplying natural daylight through a window.

The simulated daylight window of the present invention features scenic "views" built into a custom window frame and backlit by special uniform light similar to natural sunlight, with light treatment which cuts glare and improves visual effectiveness.

The natural daylight window simulating units of the present invention can be incorporated in the form of simulated window units for mounting on the wall, door units with window panels, or skylight units for mounting, for example, in the suspended ceiling of interiors of a structure.

One purpose of the present invention is to provide lighting units which create both the impression and the physical effects to a person, of receiving from such units, natural daylight, especially in a windowless environment.

It is another purpose of the present invention to provide units having the appearance of a genuine window with a sunny view or a real skylight, and the psychological benefits which this provides.

The applicant has combined various factors including a high quality backlighting system, a structural real window appearance of the unit, for example, through a shallow dimension of the unit, and a particular pictorial presentation simulating the outside environment and featuring sunny scenic views evenly backlighted, which together result in the creation of simulated natural daylight windows.

These natural daylight window simulation units were developed to help counteract mood, vision, and productivity problems often linked to windowless environments and seasonal changes in natural light. The present invention simulated window units are to give people the positive, uplifting feelings they would normally get from a real window and a pleasant sunny view.

In one preferred embodiment, a simulated natural daylight window unit includes a supporting structure, a sheet of transparency with printed indicia representing a view, and a natural-like daylight backlighting system for providing backlighting for the imprinted transparency.

The natural-like daylight backlighting system includes a source of light which provides light having a spectrum similar to that of the daylight spectrum, as well as high color accuracy and color preference. The system also includes means for providing evenly diffused backlighting for the imprinted transparency in a thin lighting system. Also, means for reducing glare on surfaces in the room may be provided to further enhance the quality of the light and accuracy of colors.

The primary features which were combined to make such simulated window and daylight units effective in providing the "feeling" of a genuine window in the room, include a scenic view back-illuminated by a natural-like daylight backlighting system combined with a very thin backlighting structure which is necessary, for example, in order for the window unit to appear natural when secured or hung on a wall.

The appearance of the window unit is an important factor and provision of, for example, venetian blinds, provision of the pictorial presentation with sunny views and appropriate scale and perspective, greatly enhance the natural window-like effect. Also, mounting of the unit at the window level is crucial.

It is also desirable to control the brightness of the backlighting for a particular room setting, the transparency used for pictorial representation, and for individual taste. The window unit should preferably include a dimmer system for the necessary adjustment of the brightness. Also, appropriate window molding to give a three-dimensional impression to the view, results in the increased effect of the natural-looking window.

The simulated daylight window unit, with appropriate molding, can also be mounted on the ceiling as a simulated skylight unit. However, in another embodiment, the skylight unit can be simply fitted into a conventional, fluorescent fixture frame, mounted in a suspended ceiling and use the fluorescent light fixtures, retrofitted with lamps with light spectrum similar to that of the day spectrum, and modified to spread the light out more evenly, as a source of illumination. Provision of a transparency with an imprinted sky view and a vertically-polarizing panel, which are backlighted, by such source of lighting, result in a unit with a natural skylight effect. The vertically-polarizing panels increase color accuracy and contrast of the backlighted view and the vertical-polarizing panel along with the transparency fitted in an overhead fluorescent fixture, produces a naturally-appearing view of the sky. The polarizing panel reduces direct glare as well as reflected glare from room surfaces (veiling glare).

The present invention will now be described in more detail with reference being made to the accompanying drawings, in which:

BRIEF DESCRIPTION OF THE DRAWINGS

FIG. 1 is a perspective view of one embodiment of a simulated day-light unit according to the present invention in the form of a window-unit mounted on a wall;

FIG. 2 is a view of another embodiment of a simulated daylight unit in the form of a skylight unit mounted in a suspended ceiling;

BEST AND VARIOUS MODES OF CARRYING OUT THE INVENTION

Figure 3:
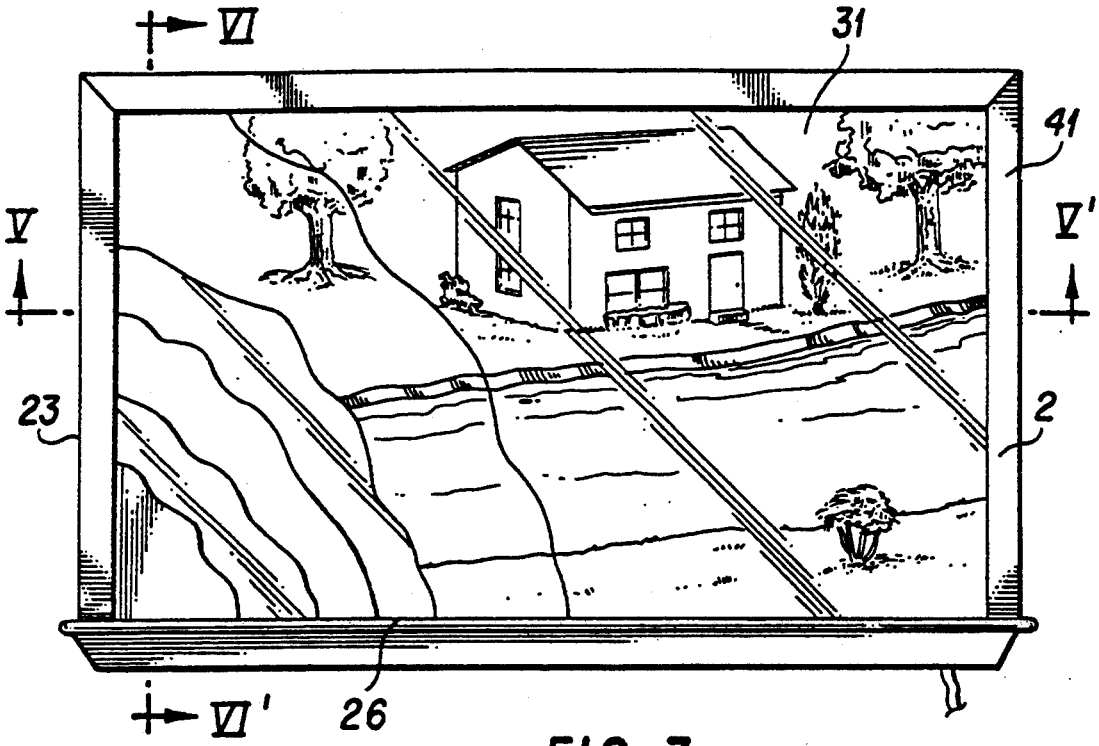
FIG. 3 is a front elevational view of the window unit with partial cross-section showing front layers.
Figure 4:
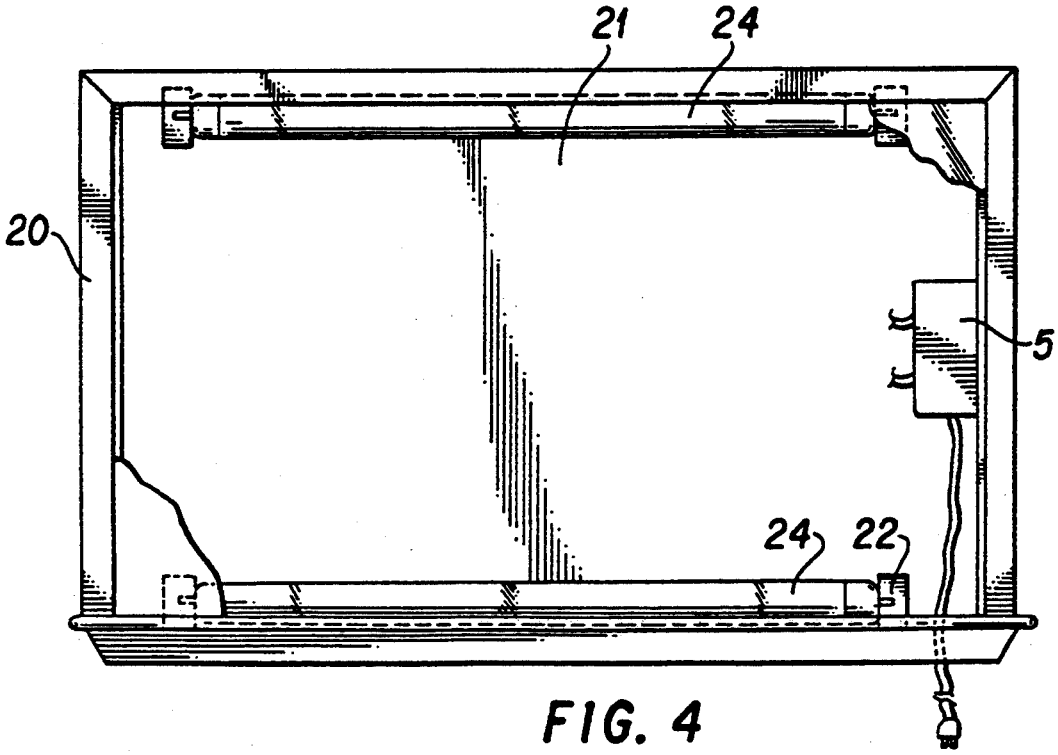
FIG. 4 is a view of the window-unit of the present invention taken from the rear side showing location of the lighting fixtures.

Referring now to the drawings, FIG. 1 shows one preferred embodiment of the present invention simulated natural-like daylight unit in the form of a simulated window unit designated as 100.

The window unit 100 includes a very shallow, box-like, supporting structure 20. The box-like structure 20 includes a substantially rectangular bottom member 21 which is to be placed on a wall in a windowless room, and four outwardly extending, narrow side members 23, each having one edge connected to one of the sides of the bottom member 21. The front of the supporting box-like structure defines an opening in which a multi-layer front member 31 of the simulated window unit 100 is supported.

Figure 6A:
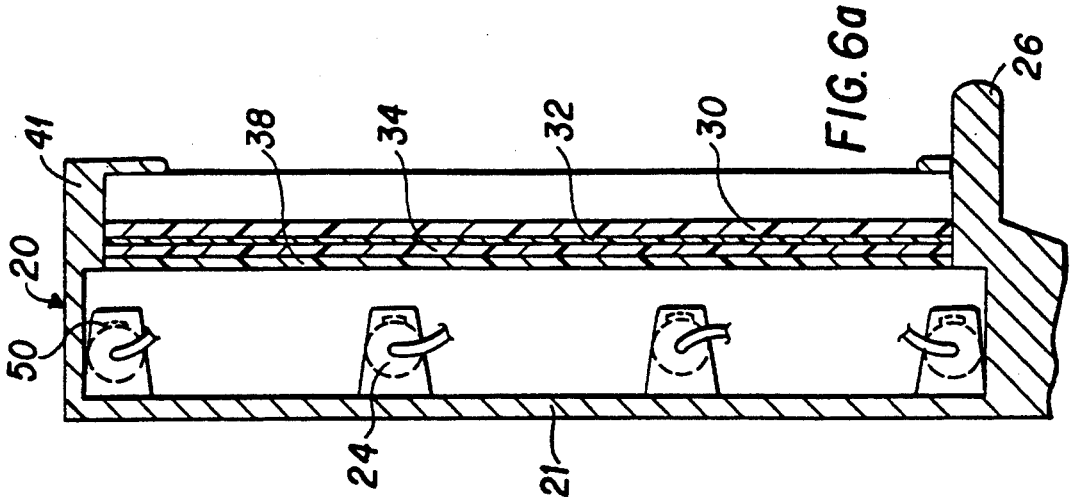
FIG. 6*a* shows another embodiment of FIG. 6.
Figure 5:
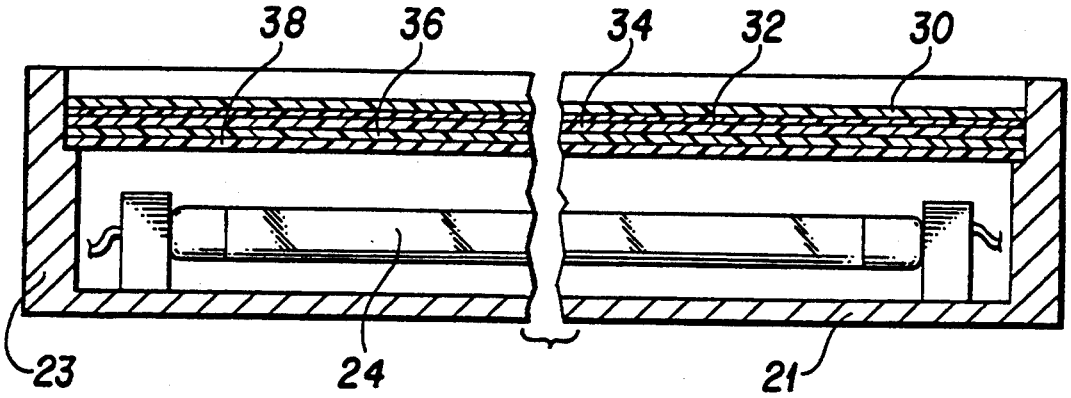
FIG. 5 is a cross-section taken along lines V—V′ of FIG. 3.
Figure 6:
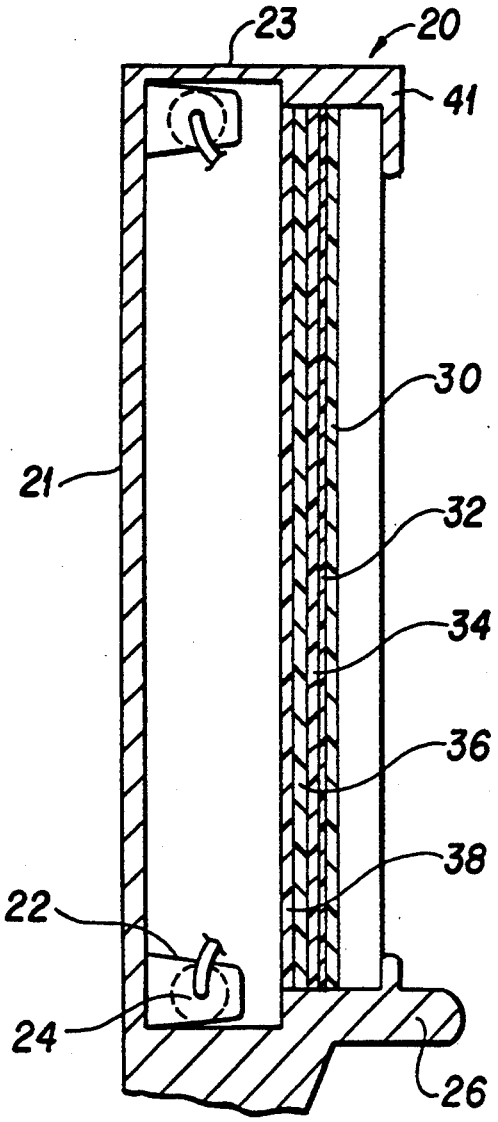
FIG. 6 is a cross-section taken along lines VI—V″ of FIG. 3.

The front member 31 of the simulated window-like unit, as best shown in FIGS. 5 and 6, includes at least a sheet of transparency 32 which has an indicia imprinted thereon representing an outdoor view and a transparent sheet, for example made of acrylic material 30 positioned in front of the sheet 32. This sheet 30 is provided primarily as protection and support for the remaining layers of the front member 31.

In order for such simulated daylight window unit to appear as a real-looking, natural window when hung on the wall, the entire structure of the simulated window unit has to very shallow. The depth of the present invention box-like structure 20 is about 2 to about 3 inches which is significantly less than in conventional backlighted panels having a depth of about 5½″–8″. Typical simulated daylight window units are 34″ high and 44″ wide.

On the other hand, in order to create a feeling of a natural daylight being delivered into the room from such simulated window unit, it is important that the light is evenly diffused through a transparency with an imprinted view representation. The backlighting system, used for illuminating the imprinted sheet of transparency has to simulate a day-like light source to create an impression of a natural, outdoor light being delivered into the room, and at the same time provide a backlighting system of very small thickness to fit into the shallow dimensions of the box-like structure.

In the preferred embodiment, the backlighting system of the present invention uses, as a source of light, fluorescent fixtures.

As shown in FIG. 3, 4, 5 and 6, the box-like supporting structure 20 of the window unit 100 houses therein at least one fluorescent fixture 24 which is mounted on the bottom member 21 between mounting members 22 which in turn are supported in the box 20.

To provide the above quality of the backlighting, the present invention simulated units employ fluorescent fixtures having a light spectrum which is similar to the outdoor daylight spectrum. The backlighting system is also designed to maximize color correctness and color preference and to minimize glare. It is also important for the entire backlighting system to generate minimum heat output, such as to minimize its effect over time on the imprinted dyes, and have flicker-free performance, and very low sound levels.

Some of this is accomplished by the use of high frequency electronic ballasts which give off less heat, substantially eliminate flicker, particularly 60cps flicker and are also much more quiet in operation than standard ballasts.

The fluorescent lamps and ballasts having the above qualities are readily available on the market. The lamps are chosen such as to have most of the natural spectrum plus some additional phosphors which enhance different colors to the way that is most preferred by people and provides high "color accuracy".

In the preferred embodiment, the front member 31 of the window box-like structure 20, in addition to the sheet member of transparent material 32, with the sheet of a polyacrylate 38 at one side, a thin, clear polyester sheet 30 can be provided on the other side of the sheet member 32 for additional support of the entire front member's structure. Also, a vertically-polarizing panel member 34 can be advantageously used. The function of the vertically-polarizing panel member 34 is primarily to reduce glare, and therefore improve the quality of the light being delivered by the simulated daylight window unit. The vertical polarization also contributes to higher accuracy of the colors.

A most crucial condition for the present invention natural daylight window simulation units is to ensure, in spite of the shallow structure of the unit, even diffusion of the natural spectrum light directed from the fluorescent lamps over the entire sheet of transparent material with an imprinted view representation. In the preferred embodiment of the present invention, such provision of an evenly diffused backlighting in a very thin backlighting structure is accomplished by the use of the principles of total internal reflection, using a 3M Brand Scotchlamp Film TM (SOLF)

Such design includes a 3M SOLF film member 36 for reflection or transmission of the light provided by the fluorescent fixtures. However, other materials providing total internal reflection can be used to reflect or transmit the light. As a part of this lighting panel system, the bottom surface of the supporting box-like member 20 is designed as a very highly specular reflecting surface near fluorescent lamps falling off to more diffuse reflective surface as the distance from the lamps increases. The remaining interior surface of the box-like structure including side member 23 should have a highly specular reflective finish.

This geometry of differing reflectivity surfaces of the interior sides and back of the light box, combined with the characteristics of the 3M SOLF film on the front surface, has the effect of controlling the "escape" of the light through the front surface (when the incident angle exceeds the angle of total internal reflection) such that a substantially even brightness results along the entire front surface of the simulated window unit. The very thin light box can be considered a light pipe with a geometrically-controlled release of the light.

The appearance of the simulated window unit as close as possible to a real window, is an important factor, and in addition to its "thinness" provision of, for example, venetian blinds 40, provision of the pictorial presentation 31 with sunny views and with an appropriate scale and perspective, greatly enhance and ensure the natural window-like effect. Also, hanging of the simulated window unit in the windowless room at a real window level as opposed to a picture level is crucial.

It is also desirable to control the brightness of the backlighting for a particular room setting, the transparency used for pictorial representation, and for individual taste. The window unit can, if desired, include a dimmer system for adjusting the brightness. Also, appropriate molding 41 together with protruding window sill 26 on the front part of the box-like structure 20 gives a three-dimensional impression to the view 31, and results in the increased effect of the natural-looking window.

Other factors adding to the quality of simulation which causes the desired impact on people, are the windowsill, the even and natural daylight spectrum light of appropriate intensity, the lack of flicker and sound, etc. Other features which might be added include a fan for a "breeze", external sounds and smells, 3-dimensional effects, etc. The simulated window units, according to the present invention in other embodiments, may include automatic changing of views, movement, electro-optic/HDTV types of images, piping in of real outdoor views or images via fibre optics, varying the brightness or position of the sun in time to simulate dawn to dusk, etc.

Figure 4A:
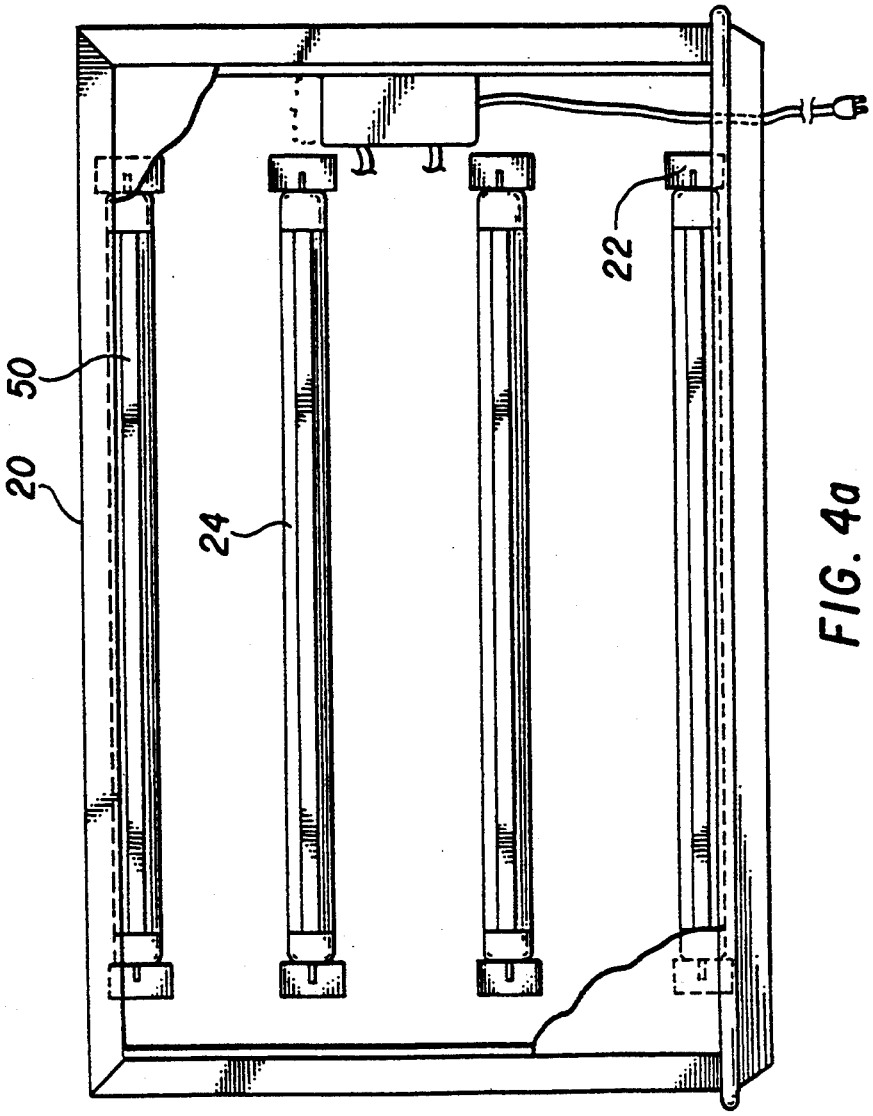
FIG. 4*a* is a view similar to that of FIG. 4 of another embodiment of the window unit.

FIGS. 4*a* and 6*a* show another embodiment of the simulated window unit 100 which is useful for providing high intensities of light when desirable and yet still retaining the qualities of thinness and evenness of light necessary for the effect. In this embodiment, the SOLF sheet layer 36 is eliminated, while additional lamps are added, and the evenness is accomplished by placing a strip of diffusing material 50 such as 3M Scotchtint over the "hot" spots of the fluorescent lamps 23 facing the front of the window unit, and spacing the fluorescent lamps such that the overlapping intensities due to each add up to the required levels of evenness. The entire interior surface of the light box is highly reflective in this embodiment.

Figure 7A:
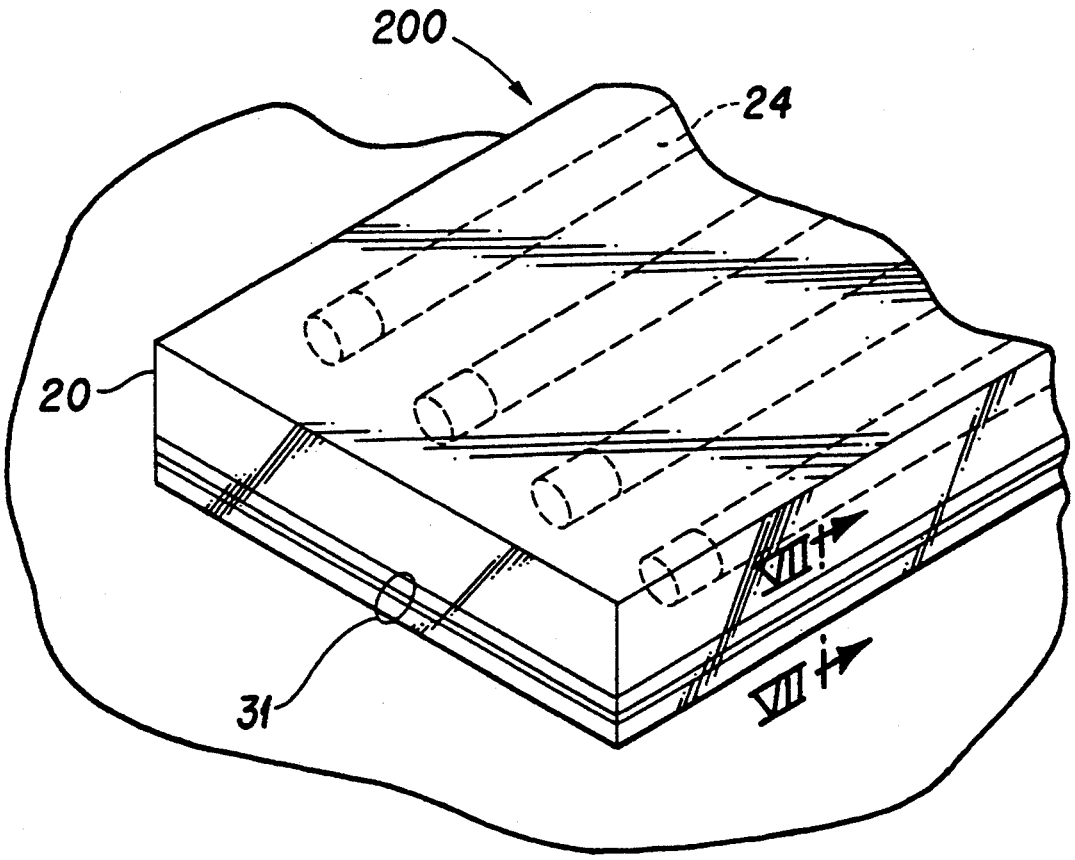
FIGS. 7*a* and 7*b* show, respectively, an end view, partially in cross-section of a skylight unit and a detail showing a cross-section view of the front layers.
Figure 7B:
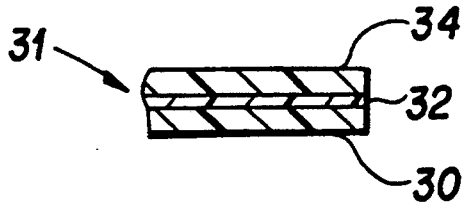

The simulated daylight window unit described above can also be mounted on the ceiling as a simulated skylight unit. FIGS. 2 and 7*a*, 7*b* show another embodiment of the present invention daylight unit in which the skylight unit 200 is simply fitted into a conventional, fluorescent fixture frame, mounted in a suspended ceiling 10 and uses the fluorescent light fixtures 23 with strips of diffusing material 50, with a light spectrum similar to that of the day spectrum, as a source of illumination.

As best shown in FIGS. 7*a* and 7*b*, a multilayer front member 31 of the skylight unit 200 includes a vertically-polarizing panel 34, a sheet member 32 made of transparent material with imprinted indicia representing a sky view and acrylic lens member 30. The imprinted view representation could also be provided directly on the vertically-polarizing panel 34 or on the acrylic lens 30. The combination of the lighting source delivering light having a spectrum similar to the daylight spectrum, diffused over a multilayer member with imprinted representation of the sky view, results in the ceiling unit with a real sky-light effect.

Although the principles of the present invention have been described with reference to a particular embodiment, by way of example, it is understood that modifications may suggest themselves to those skilled in the art and it is intended that such modifications fall within the scope of the claims.

I claim:

1. A natural daylight window simulation unit comprising:

a box-like structure having a top having a front surface, a bottom parallel to said top, two sides parallel to each other, each of said sides having a front surface, a substantially flat back suitable for hanging flush against a wall and a front comprised of a multi-layer light diffusing member including an indicia sheet of one of transparent or translucent material having an imprinted indicia thereon representing a view derived from a photograph of an outdoor scene;

window frame molding provided on said box-like structure, to simulate a natural window;

a window sill member which forms a part of said box-like structure and protrudes outwardly from said box-like structure beyond a plane formed by said window frame molding;

a natural daylight-like spectrum backlighting system, including all associated electrical components, being dimensioned to fit into said box-like structure and being supported in said box-like structure, said backlighting system comprising a plurality of light sources, each of said light sources having a light emitting outer surface and associated therewith a second light diffusing member which is located adjacent to each respective light source and which extends along a length and covers only a portion of said light emitting outer surface of each of said light sources which faces said multi-layer light diffusing member of said box-like structure; and said-multi-layer light diffusing member comprising:

a sheet of one of clear or translucent material located between said natural daylight-like spectrum backlighting system and said indicia sheet of one of transparent or translucent material having an imprinted indicia thereon for receiving light from said natural daylight-like spectrum backlighting system and diffusing said light;

said indicia sheet of one of transparent or translucent material having an indicia imprinted thereon and being located in front of said sheet of one of clear or translucent material; and a sheet of clear lens material located in front of said indicia sheet of one of transparent or translucent material for providing support and protection for said indicia sheet;

wherein said box like structure is adapted to be positioned on a wall at a level of a real window.

2. The natural daylight window simulation unit of claim 1, wherein said multi-layer light diffusing member further comprises a sheet of vertically polarizing material located in front of said sheet of one of clear or translucent material for polarizing light received through said sheet of one of clear or translucent material.

3. The natural daylight window simulation unit of claim 1, wherein said second light diffusing member is formed of a rectangular shaped piece of film material.

4. The natural daylight window simulation unit of claim 1, wherein each of said light sources of said natural daylight-like spectrum backlighting system provides light with a light spectrum similar to a daylight spectrum.

5. The natural daylight window simulation unit of claim 1, wherein said box-like structure has a depth of about 2 to 3 inches.

6. The natural daylight window simulation unit of claim 1, wherein each of said light sources comprises at least one fluorescent fixture.

7. The natural daylight window simulation unit of claim 6, wherein each of said light sources further comprises at least one high frequency ballast.

8. A method of providing a simulation of a natural daylight window in an indoor space, comprising steps of:

providing a box-like structure having a top having a front surface, a bottom parallel to said top, two sides parallel to each other, each of said sides having a front surface, a substantially flat back suitable for hanging flush against a wall and a front formed from a multi-layer light diffusing member including an indicia sheet of one of transparent or translucent material having an imprinted indicia thereon representing a view derived from a photograph of an outdoor scene;

mounting said box-like structure on the surface of a wall at a level of a real window such that said top, bottom and two sides of said box-like structure protrude outwardly from said surface of said wall in a direction perpendicular to said surface of said wall and such that said back of said box-like structure is flat against said wall;

forming window frame molding on said box-like structure to simulate a natural window;

forming a window sill member as a part of said box-like structure, said window sill member protruding outwardly from said box-like structure beyond a plane formed by said window frame molding;

mounting in said box-like structure a backlighting system, including all associated electrical components, comprising at least one light source, each of said at least one light source having a light emitting outer surface land associated therewith a second light diffusing member which is located adjacent to each respective light source and which extends along a length and covers only a portion of said light emitting outer surface, said covered portion being at least a part of the light emitting outer surface of each of said at least one light source which faces said multi-layer light diffusing member of said box-like structure; and providing said multi-layer light diffusing member with;

a sheet of one of clear or translucent material located between said natural daylight-like spectrum backlighting system and said indicia sheet of one of transparent or translucent material having an imprinted indicia thereon for receiving light from said natural daylight-like spectrum backlighting system and diffusing said light;

said indicia sheet of one of transparent or translucent material having an indicia imprinted thereon and being located in front of said sheet of one of clear or translucent material; and a sheet of clear lens material located in front of said indicia sheet of one of transparent or translucent material.

9. The method of claim 8, further including the step of providing a vertically polarizing member as part of said multi-layer light diffusing member for reducing glare on interior surfaces of said indoor space.

10. The method of claim 8, wherein said box-like structure protrudes between 2 and 3 inches outwardly from said surface of said wall.

11. A natural daylight window simulator unit comprising:

a box-like structure having a top having a front surface, a bottom parallel to said top, two sides parallel to each other, each of said sides having a front surface, a back suitable for hanging flush against a wall at a level of a real window and a front comprised of a multi-layer light diffusing member including an indicia sheet of one of transparent or translucent material having an imprinted indicia thereon representing a view derived from a photograph of an outdoor scene;

window frame molding provided on said box-like structure to simulate a natural window;

a window sill member forming a part of said box-like structure and which projects beyond a plane formed by said window frame molding;

a natural daylight-like spectrum backlighting system supported in said box-like structure, said backlighting system, including all associated electrical components, being dimensioned to fit into said box-like structure and comprising at least one light source, each of said at least one light source having a light emitting outer surface and associated therewith a second light diffusing member which is located between each of said at least one light source and said indicia sheet in said multi-layer light diffusing member; and said multi-layer light diffusing member comprising:

a sheet of one of clear or translucent materials located between said natural daylight-like spectrum backlighting system and said indicia sheet of one of transparent or translucent material having an imprinted indicia thereon for receiving light from said natural daylight-like spectrum backlighting system and diffusing said light; and said indicia sheet of one of transparent or translucent material having an indicia imprinted thereon and being located in front of said sheet of one of clear or translucent material.

12. The natural daylight window simulation unit of claim 11, wherein said second light diffusing member associated with each of said at least one light source extends adjacent along substantially the entire length of light emitting outer surface of each of said respective light source and covers only a portion of said light emitting outer surface, said covered portion being part of the light emitting outer surface of each of at least one light sources which faces said multi-layer light diffusing member of said box-like structure.

13. The natural daylight window simulation unit of claim 11, wherein said second light diffusing member associated with each of said at least one light source comprises a sheet of film material for reflection and transmission of light from said at least one light source, and extends behind said indicia sheet of one transparent or translucent material of said multi layer diffusing member.

14. The natural daylight window simulation unit of claim 11, wherein said multi-layer light diffusing member further comprises a sheet of vertically polarizing material located in front of said sheet of one of clear or translucent material for polarizing light received through said sheet of one of clear or translucent material.

15. The natural daylight window simulation unit of claim 11, wherein each of said at least one light source of said natural daylight-like spectrum backlighting system provides light with a light spectrum similar to a daylight spectrum.

16. The natural daylight window simulation unit of claim 11, wherein said box-like structure has a depth of about 2 to 3 inches.

17. The natural daylight window simulation unit of claim 11, wherein each of said at least one light source comprises at least one fluorescent fixture.

18. The natural daylight window simulation unit of claim 11, wherein each of said at least one light sources further comprises at least one high frequency ballast.

19. The natural daylight window simulation unit of claim 11, wherein said multi-layer light diffusing member further comprises a sheet of clear lens material located in front of said indicia sheet of one of transparent or translucent material for providing support and protection for said indicia sheet of one of transparent or translucent material.

20. A natural daylight window simulation unit comprising:

a box-like structure having a top having a front surface, a bottom parallel to said top, two sides parallel to each other, each of said sides having a front surface, a substantially flat back suitable for hanging flush against a wall and a front comprised of a multi-layer light diffusing member including an indicia sheet of one of transparent or translucent material having an imprinted indicia thereon representing a view derived from a photograph;

window frame molding provided on said box-like structure, to simulate a natural window;

a window sill member which forms a part of said box-like structure and protrudes outwardly from said box-like structure beyond a plane formed by said window frame molding;

a natural daylight-like spectrum backlighting system, including all associated electrical components, being dimensioned to fit into said box-like structure and being supported in said box-like structure, said backlighting system comprising a plurality of light sources, each of said light sources having a light emitting outer surface and associated therewith a second light diffusing member which is located adjacent to each respective light source and which extends along a length and covers only a portion of said light emitting outer surface of each of said light sources, which faces said multi-layer light diffusing member of said box-like structure; and said multi-layer light diffusing member comprising:

a sheet of one of clear or translucent material located between said natural daylight-like spectrum backlighting system and said indicia sheet of one of transparent or translucent material having an imprinted indicia thereon for receiving light from said natural daylight-like spectrum backlighting system and diffusing said light;

said indicia sheet of one of transparent or translucent material having an indicia imprinted thereon and being located in front of said sheet of one of clear or translucent material; and a sheet of clear lens material located in front of said indicia sheet of one of transparent or translucent material for providing support and protection for said indicia sheet;

wherein said box like structure is adapted to be positioned on a wall at a level of a real window.

21. A method of providing a simulation of a natural daylight window in an indoor space, comprising steps of:

providing a box-like structure having a top having a front surface, a bottom parallel to said top, two sides parallel to each other, each of said sides having a front surface, a substantially flat back suitable for hanging flush against a wall and a front formed from a multi-layer light diffusing member including an indicia sheet of one of transparent or translucent material having an imprinted indicia thereon representing a view derived from a photograph;

mounting said box-like structure on the surface of a wall at a level of a real window such that said top, bottom and two sides of said box-like structure protrude outwardly from said surface of said wall in a direction perpendicular to said surface of said wall and such that said back of said box-like structure is flat against said wall;

forming window frame molding on said box-like structure to simulate a natural window;

forming a window sill member as a part of said box-like structure, said window sill member protruding outwardly from said box-like structure beyond a plane formed by said window frame molding;

mounting in said box-like structure a backlighting system, including all associated electrical components, comprising at least one light source, each of said at least one light source having a light emitting outer surface and associated therewith a second light diffusing member which is located adjacent to each respective light source and which extends along a length and covers only a portion of said light emitting outer surface, said covered portion being at least a part of the light emitting outer surface of each of said at least one light source which faces said multi-layer light diffusing member of said box-like structure: and providing said multi-layer light diffusing member with:

a sheet of one of clear or translucent material located between said natural daylight-like spectrum backlighting system and said indicia sheet of one of transparent or translucent material having an imprinted indicia thereon for receiving light from said natural daylight-like spectrum backlighting system and diffusing said light;

said indicia sheet of one of transparent or translucent material having an indicia imprinted thereon and being located in front of said sheet of one of clear or translucent material; and a sheet of clear lens material located in front of said indicia sheet of one of transparent or translucent material.

* * * * *

UNITED STATES PATENT AND TRADEMARK OFFICE

CERTIFICATE OF CORRECTION

PATENT NO. : 5,426,879

DATED : June 27, 1995

INVENTOR(S) : Irv HECKER

It is certified that error appears in the above-indentified patent and that said Letters Patent is hereby corrected as shown below:

Column 6, line 38, change "23" to --24--;

Column 6, line 50, change "23" to --24--.

Signed and Sealed this

Fourteenth Day of November, 1995

*Attest:*

*Attesting Officer*

Bruce Lehman

BRUCE LEHMAN

*Commissioner of Patents and Trademarks*